United States Patent [19]

Rivas

[11] Patent Number: 4,682,655

[45] Date of Patent: Jul. 28, 1987

[54] SLOTTED HOUSING HAVING MULTIPLE SEATS FOR SUPPORTING AND LOCATING SUBMERSIBLE PUMPS IN DEEP WELLS

[75] Inventor: Olegario Rivas, San Antonio, Venezuela

[73] Assignee: Intevep, S.A., Caracas, Venezuela

[21] Appl. No.: 910,016

[22] Filed: Sep. 22, 1986

[51] Int. Cl.[4] ..... E21B 43/12

[52] U.S. Cl. ..... 166/369; 166/68.5; 137/565; 417/361

[58] Field of Search ..... 166/68.5, 105, 369, 166/370, 372; 47/238, 442, 359, 361; 137/565

[56] References Cited

U.S. PATENT DOCUMENTS

| | | | |
|---|---|---|---|
| 3,209,834 | 10/1965 | Essary | 166/105 X |
| 4,014,630 | 3/1977 | Drutchas | 417/283 |
| 4,237,976 | 12/1980 | Wilson | 166/369 X |
| 4,532,986 | 8/1985 | Mims et al. | 166/50 |
| 4,565,245 | 1/1986 | Mims et al. | 166/50 |

*Primary Examiner*—Stephen J. Novosad
*Assistant Examiner*—William P. Neuder
*Attorney, Agent, or Firm*—Bachman & LaPointe

[57] ABSTRACT

A well pumping system operative selectively to pump fluids (1) through the production tube and the annular space between the production tube and the well casing simultaneously (2) through the production tube solely or (3) through the annular space solely, without having to pull the rod string and/or the tube string.

6 Claims, 5 Drawing Figures

SLOTTED HOUSING HAVING MULTIPLE SEATS FOR SUPPORTING AND LOCATING SUBMERSIBLE PUMPS IN DEEP WELLS

BACKGROUND OF THE INVENTION

The present invention relates to pumping fluids such as viscous crude oil from high productivity deep wells utilizing a submersible pump suspended from a rod string disposed in a production tube within the well casing.

Conventionally, the annular space between the casing and the production tubing string below the pump is sealed from the lower portion of the well formation by a packing or a gland. The production tube is perforated near the discharge side of the pump so that production fluid is advanced upwardly by the pump through the production tube and through the annular space. The pump is suspended usually from a rod string or sucker rod and there is but one operative pumping system. That is, there is no alternative flow path other than through the production tube and through the annular space simultaneously.

While arrangements of this type are operative they have the disadvantage of generating excessive down time and considerable expense when trouble develops in the well or when production diminishes. In such situations, the rod string and the suspended pump must be pulled from the well. Depending upon the difficulty it may even be necessary to pull the production tubing string.

Furthermore, it is frequently desirable when the fluid pump is of a high viscosity to maintain a supply of low viscosity fluid in the production tube for lubrication and dilution while producing high viscosity fluid, solely through the annular space.

Obviously to accomplish a change in pumping flow paths in prior art systems, it is necessary to pull the rod string and the tubing string to shift from one pumping mode to another at a substantial loss of time and with concomitant addition expense.

SUMMARY OF THE INVENTION

Consequently, it is a principal object of the present invention to provide a slotted housing which facilitates production of well fluids through a plurality of different flow paths, selectively, without having to pull the pump, the rod string and the tubing string from the well.

More explicitly, it is a principal feature of the present invention to provide a pumping system operative selectively to pump (1) through the production tube and the annular space between the production tube and the well casing simultaneously, (2) through the production tube solely or (3) through the annular space solely, as desired, without having to pull the rod string and/or the tubing string.

A further feature of the invention is the provision of slotted housing in the form of a tubular element or a sleeve which is operable to connect in series with the conventional production tubing string.

A further feature of the invention is the provision of a slotted housing which includes a plurality of seat means for engaging, supporting and locating a submersible pump where each seat means in combination with the pump housing develops a valve action and a distinct fluid flow path.

A further feature of the invention is the provision of a plurality of through apertures in the slotted housing in a region between at least two of said seat means.

A still further feature of the present invention is the provision of a slotted housing in the form of a tubular element adapted to make a threaded connection in series with the production tubing string where the slotted housing includes a plurality of seat means operable to engage, support and position a submersible pump and a stuffing box or seal means, said tubular element including at least one through aperture providing communication from the interior of the tubing string to the annular space between the tubing string and the well casing so that depending upon the position of the pump housing and the stuffing box relative to the several seat means, the flow of product fluid may take, selectively, one of three different paths, i.e. through the production tube solely, through the production tube and the annular space simultaneously or through the annular space solely. All these selective flow paths can be developed rapidly and economically without the need to dismantel and pull the rod and tubing strings.

A further feature of the invention is the novel cooperation between a slotted housing and the housing or casing of a submersible pump.

A still further feature of the invention is a provision of a valve system which involves a minimum number of piece parts.

Among other advantages and features of the invention are the following:

1. Small number of moving parts;
2. The pump casing in combination with the slotted housing cooperate to effect a valve action;
3. Three different valve settings are possible selectively and rapidly without having to resort to pulling the system from the well;
4. The slotted housing is a relatively uncomplicated tubular structure which is inexpensive to fabricate;
5. The slotted housing, by virtue of its threaded ends, facilitates inclusion in the tubing string at any point along the string;
6. The system, by virtue of the choice of flow paths, reduces "down" time greatly by reducing the necessity and frequency of pulling the system; and
7. The slotted housing, in its tubular form, with inwardly protuberant seat means serves to position the pump in place securely and concentrically relative to the production tube.

A fluid production pumping system for oil wells and the like embracing certain principles of the invention may include a well casing, a fluid production tube within the casing spaced from the casing to define an annular space between the casing and the tube, slotted housing in series with a production tube said slotted housing defining a sleeve having at least one aperture leading from the interior of the tube to the annular space, stope or seat means for locating and seating a submersible pump in at least two distinct positions relative to said aperture whereby said pump is operable selectively to assume a first position relative to said slotted housing effective to discharge product through the said annular space and said tube and to assume a second position to discharge product through said tube without the need to withdraw and dismantel the pumping system.

A method of effecting a valve action within the well embracing certain other principles of the invention may comprise the steps of incorporating a length of tubing in the tubing string having a through aperture, lowering the tubing string until the aperture arrives at the region of the surface of the fluid to be pumped, thereafter lowering a submersible pump inside the tubing string and effecting a valve action by changing the location of the pump relative to said aperture.

A slotted housing embracing additional principles of the invention may comprise a hollow tubular element having threaded ends and an intermediate through slot said element having a plurality of seat means on the interior thereof for locating a pump means disposed therein.

Other features and advantages of the present invention will become more apparent from the examination of the succeeding specification when read in conjunction with the appended drawings, in which:

DETAILED DESCRIPTION OF THE PREFERRED EMBODIMENTS

Figure 2:
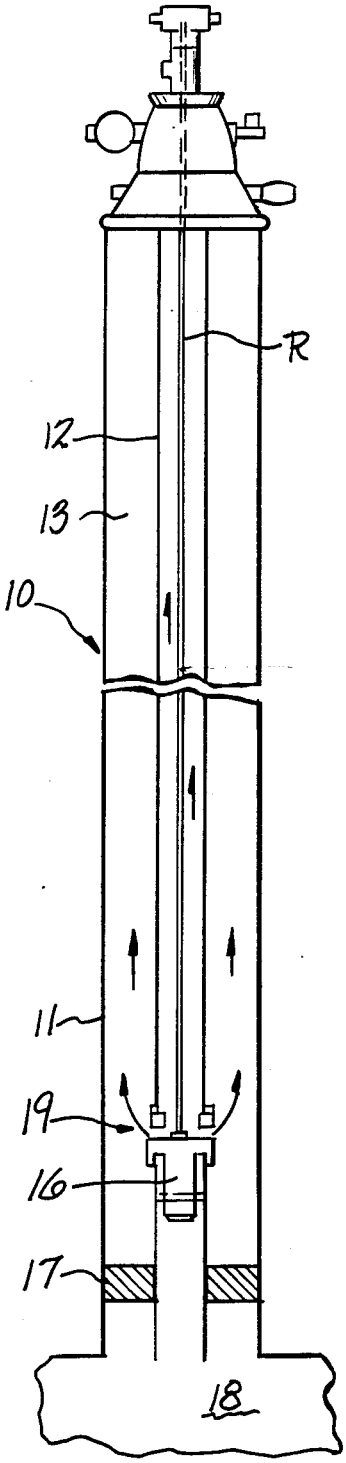
FIG. 2 is a schematic illustration of the well hole casing, production tube and the bottom of the formation with the pumping system set for pumping product through the annular space and the production tube simultaneously.

Referring now to the drawings, in particular FIG. 2, reference numeral 10 designates a typical deep well arrangement in which the present invention is operative including a casing 11, a production tubing string 12, an annular space 13 between the casing 11 and the production tubing string 12, a submersible pump 16 and a packing 17 for sealing the annular space from the bottom of the formation 18.

The reference numeral 19 designates through slots providing communication between the interior of the production tube and the annular space 13 whereby the arrangement of FIG. 2 is operative to pump fluid upwardly through the production tube 12 and through the annular space 13 simultaneously as indicated by the arrows.

Figure 1:
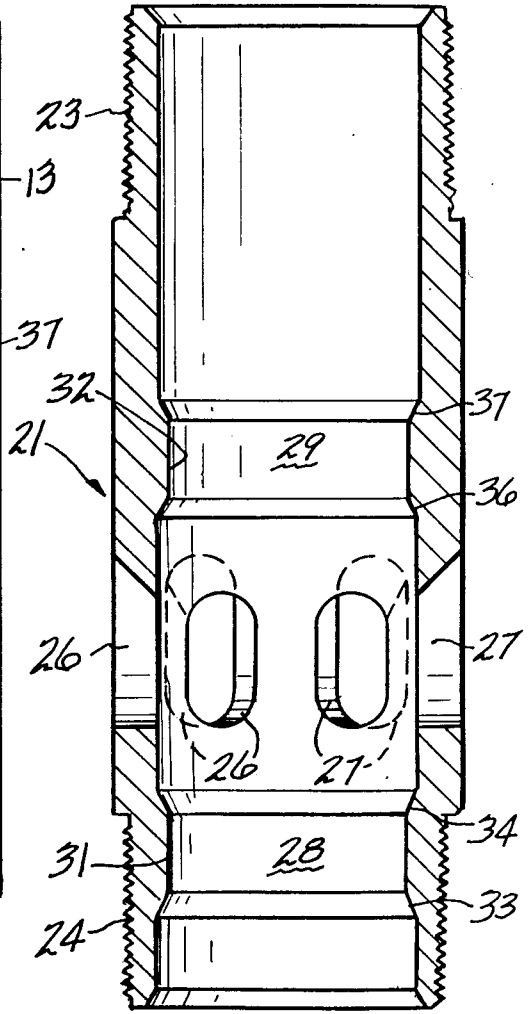
FIG. 1 is a vertical section of the slotted housing.
Figure 3:
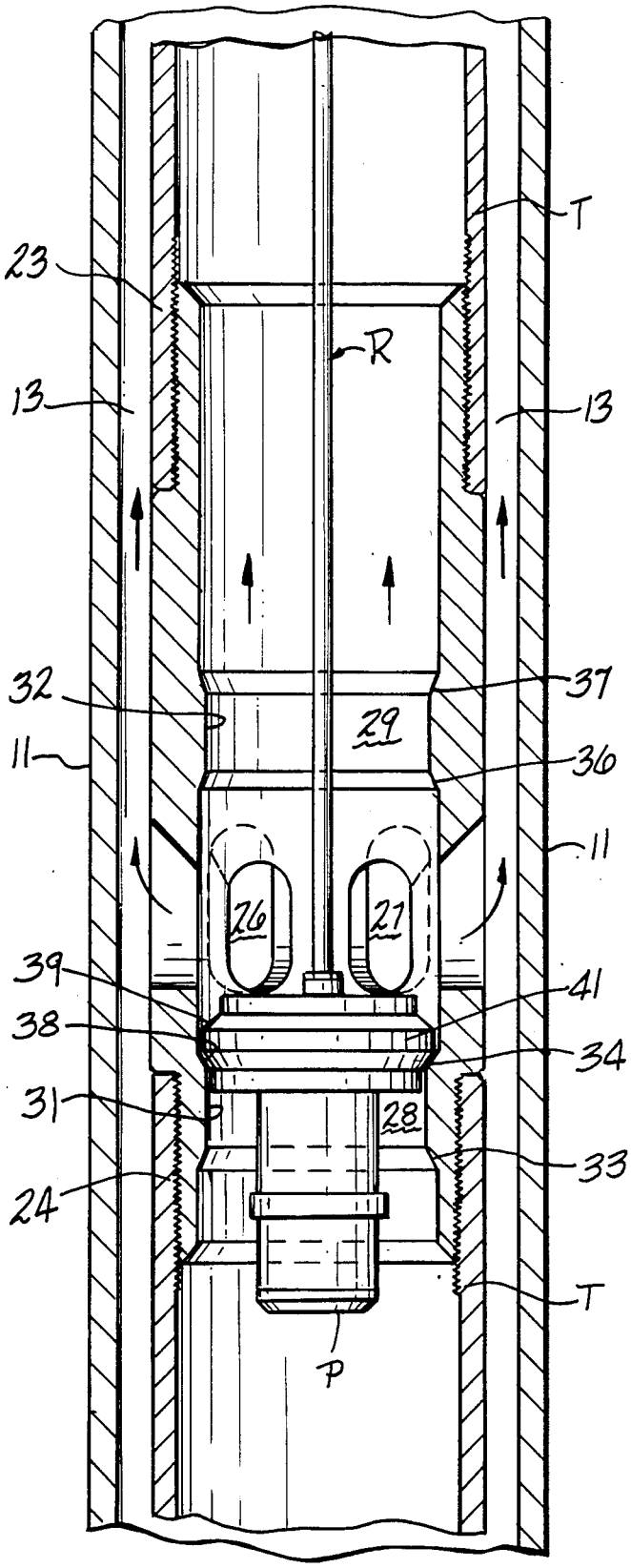
FIG. 3 is an enlarged view of the valve arrangement of FIG. 3 showing the submersible pump, suspended by a rod string, seated below through apertures permitting flow dually through the annular space and the production tube as indicated by the arrows.

A reference to FIGS. 1 and 3 provides an enlarged view of the slotted housing indicated generally at 21 and its cooperation with the pump P to effect the flow paths of FIG. 2.

The slotted housing 21 defines a hollow cylindrical body or sleeve 22 making a threaded connection at 23 and 24 with the tubing string T. The slotted housing includes a plurality of through apertures 26 and 27 straddled by seat means 28 and 29.

The seat means are generally of the same configuration and include inwardly projecting, annular beads 5 or protuberances 31 and 32 bounded by bevelled margines 33, 34 36 and 37.

The bevelled margins provide seats or positioning points for engagement with mating bevels 38 and 39 formed on the housing 41 of the submersible pump P.

Obviously the angle of the bevel is not critical so long as there is a neat fit between the seat means and the pump housing to effect a seal and to position the pump concentrically and at the correct vertical distance from the slots or apertures 26–27.

The pump P is suspended and moved up and down vertically by means of the rod string R.

Note that in FIG. 3 the pump is positioned below the slots 26–27 which, for purposes of claiming the invention, is termed the first position and the seat means 28 is termed the first seat means.

In the first position the upper bevel 34 of seat means 28 engages mating lower bevel 38 on the pump housing 41. In this position fluid product is discharged upwardly through the tube T and through the annular space 13 via the slots 26–27 as indicated by the arrows of FIGS. 2 and 3.

Figure 4:
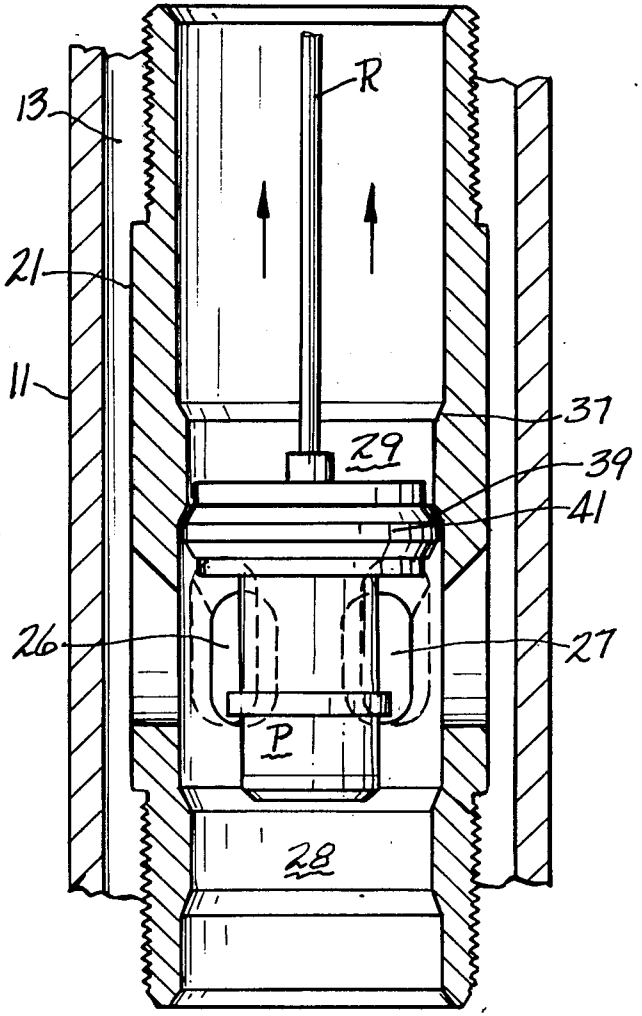
FIG. 4 is similar to FIG. 3 showing the submersible pump seated in a second position above the apertures in which the flow path is limited to the production tube, and, FIG. 5 shows the submersible pump in the position of FIG. 3 with a stuffing box or seal means seated on an upper seat means blocking flow through the production tube while directing flow through the annular space.

Referring to FIG. 4, the pump P is shown in the second position in contact with the seat means 29, referred to in the succeeding claims as the second seat means.

In this position the upper bevel 39 of the pump housing 41 is nested into the lower bevelled margin 36 of the upper or second seat means 29.

Thus, in the second position of the pump means valving action between the pump housing 41 and the slotted housing is effective to cut off flow through slots 26 and 27 and flow is directed solely through the product tubing string T as indicated by the arrows of FIG. 4.

Figure 5:
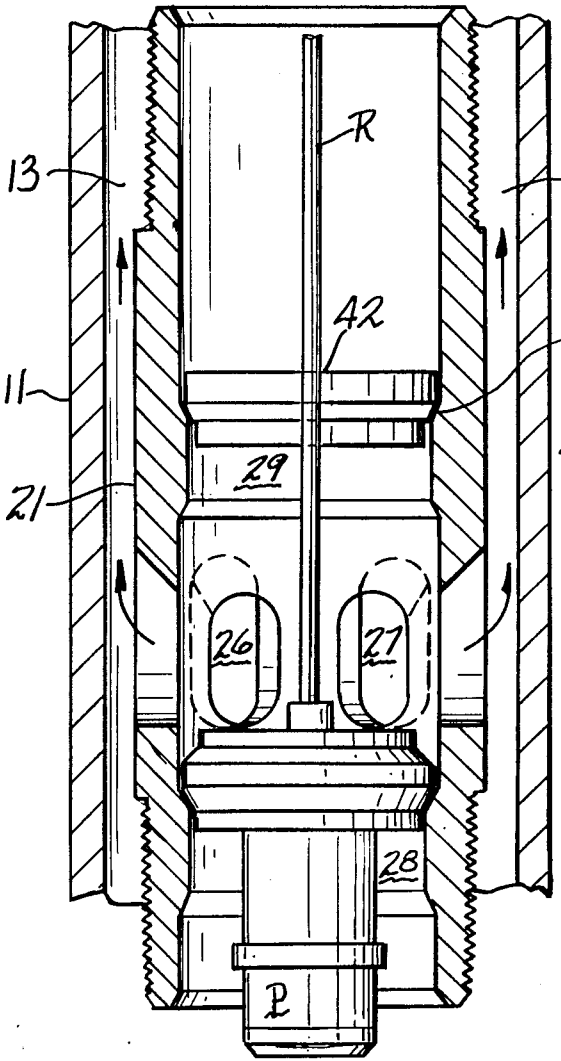

FIG. 5 shows the pump means and its housing 41 in the first position as described previously with respect to FIG. 3.

In the system of FIG. 5 a gland or stuffing box 42 is dropped downwardly, guided by the rod string R where upon the stuffing box seats itself on the upper bevel 37 of upper seat means 29. The stuffing box is suitably bevelled to match or mate with the upper seat means to form a seal which is impervious to viscous fluids such as heavy crude oil but somewhat pervious to low viscosity fluids such as light oil.

Thus, in the valving arrangement of FIG. 5 the product tubing string T is blocked and fluid discharging from pump P flows solely through the annular space 13 via slots or apertures 26 and 27 as indicated by the arrows.

In the arrangement of the pumping system shown in FIG. 5 it is sometimes desirable to fill the product tubing string T with low viscosity fluid to hold the stuffing box 42 in place.

In addition a slight weeping or seeping of low viscosity fluid through the stuffing box into the discharge side of the pump P acts to create favorable flow characteristics in the relatively viscous fluid being pumped solely through the annular space 13.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. In a fluid product pumping system for deep fluid well formations including a well casing surrounding fluid product tubing string to define an annular space between the casing and the tubing string, a method of creating a valve action in the tubing string comprising the steps of:

forming at least one through aperture in the product tubing string, lowering the tubing string into the well until the aperture reaches the region of the surface of the fluid to be pumped, sealing a lower region of said annular space to isolate the formation, supporting a submersible pump having a housing on a rod string within the product tubing string in a pumping relationship with said fluid, and utilizing the pump housing in cooperation with said tubing string to control fluid flow of product from said pump through said aperture by selectively positioning said pump housing above and below said aperature such that when the pump housing is below the aperature the product flows through the tubing string and through the annular space simultaneously and when the pump housing is above the aperature the product flows solely through said tubing string.

2. The method of claim 1 including positioning a seal means in said tubing string above said aperature for blocking product flow through said tubing string when said pump housing is positioned below said aperature.

3. In a fluid product pumping system for deep fluid well formations including a well casing surrounding fluid product tubing string to define an annular space between the casing and the tubing string, a method for pumping a high viscosity fluid product comprising the steps of:

forming at least one through aperture in the product tubing string, lowering the tubing string into the well until the aperture reaches the region of the surface of the fluid to be pumped, sealing a lower region of said annular space to isolate the formation, supporting a submersible pump having a housing on a rod string within the product tubing string in a pumping relationship with said fluid, and utilizing the pump housing in cooperation with said tubing string to control fluid flow of product from said pump through said aperture, positioning a seal means in said tubing string above said pump so as to block product flow through said tubing string when said pump housing is positioned below said aperture.

4. The method of claim 3 including placing a low viscosity fluid in the tubing string above said seal means so as to exert a pressure over said seal means such that said low viscosity fluid seeps around said seal means into the high viscosity fluid product being pumped thereby reducing the viscosity of said fluid product.

5. A fluid product pumping system for fluid wells comprising:

a well casing;

a fluid production tubing string within the casing spaced from the casing to define an annular space between the casing and the tubing string;

a slotted housing in series with and forming a part of the tubing string, said slotted housing defining a hollow cylindrical body having at least one aperture leading from the interior of the tubing string to the annular space, said body having on the interior surface thereof a first seat means below said at least one aperture, a second seat means above said at least one aperture and a third seat means above said second seat means;

a submersible pump supported movably within said body; and rod means for moving said pump relative to said aperture for selectively positioning said pump on said first seat means and said second seat means to effect a valving action wherein the product flows through said annular space when said pump is on said first seat means and said product flows through said tubing string when said pump is positioned on said second seat means.

6. The system of claim 5 further including seal means positioned on said third seat means for blocking product flow through said tubing string when said pump is positioned on said first seat means.

* * * * *